US009505014B2

(12) United States Patent
Mitsui et al.

(10) Patent No.: US 9,505,014 B2
(45) Date of Patent: Nov. 29, 2016

(54) ROTARY ATOMIZING HEAD FOR ELECTROSTATIC COATER

(71) Applicant: Toyota Jidosha Kabushiki Kaisha, Aichi (JP)

(72) Inventors: Michio Mitsui, Kanagawa (JP); Ryuji Tani, Chiba (JP); Isamu Yamazaki, Aichi (JP); Toru Yokota, Aichi (JP)

(73) Assignees: TOYOTA JIDOSHA KABUSHIKI KAISHA, Aichi (JP); RANSBURG INDUSTRIAL FINISHING K.K., Kanagawa (JP)

( * ) Notice: Subject to any disclaimer, the term of this patent is extended or adjusted under 35 U.S.C. 154(b) by 316 days.

(21) Appl. No.: 13/765,929

(22) Filed: Feb. 13, 2013

(65) Prior Publication Data

US 2013/0153681 A1 Jun. 20, 2013

Related U.S. Application Data

(63) Continuation of application No. PCT/JP2011/068453, filed on Aug. 12, 2011.

(30) Foreign Application Priority Data

Aug. 25, 2010 (JP) ..... 2010-188344

(51) Int. Cl.
*B05B 3/10* (2006.01)
*B05B 5/04* (2006.01)
*B05B 3/02* (2006.01)

(52) U.S. Cl.
CPC ..... *B05B 3/02* (2013.01); *B05B 3/025* (2013.01); *B05B 3/1014* (2013.01);

(Continued)

(58) Field of Classification Search
CPC ..... B05B 5/025; B05B 5/0225; B05B 5/04; B05B 5/0411; B05B 5/0426; B05B 5/0422; B05B 3/1064; B05B 3/1007; B05B 3/1014; B05B 3/1021; B05B 3/1035; B05B 3/1042
USPC ..... 239/703, 704, 700, 701, 223, 224
See application file for complete search history.

(56) References Cited

U.S. PATENT DOCUMENTS 4,776,520 A * 10/1988 Merritt ..... 239/700
4,919,333 A * 4/1990 Weinstein ..... B05B 3/1064 239/223

(Continued)

FOREIGN PATENT DOCUMENTS

JP 07-213991 8/1995
JP 08-024721 1/1996

(Continued)

OTHER PUBLICATIONS

International Search Report issued in corresponding International Patent Application No. PCT/JP2011/068453 dated Oct. 18, 2011 (2 pages).

(Continued)

*Primary Examiner* — Arthur O Hall
*Assistant Examiner* — Christopher R Dandridge
(74) *Attorney, Agent, or Firm* — Kilyk & Bowersox, P.L.L.C.

(57) ABSTRACT

A rotary atomizing head enables cleaning by decomposing from the atomizing head, and enables internal cleaning without decomposing to individual components when paint is changed to a new one of another color. A structural component has a front wall acting as a hub, side wall extending rearward from an outer circumferential perimeter of the front wall to make a circumferentially continuous plane, legs each having a pawl and a bottom wall. The structural component is detachably mounted in a central concavity of an atomizing head body. A bottom wall of the structural component has formed a spoon-cut recess. The central concavity has an inclined circumferential wall, and the side wall of the structural component has an inclined outer circumferential surface complementary with the circumferential wall of the atomizing head body to get in substantial contact with the circumferential wall throughout the entire area of the outer circumferential wall.

12 Claims, 8 Drawing Sheets

(52) U.S. Cl.
CPC ..... *B05B 5/0407* (2013.01); *B05B 3/1007* (2013.01); *B05B 3/1064* (2013.01); *B05B 5/04* (2013.01); *B05B 5/0426* (2013.01)

(56) References Cited

U.S. PATENT DOCUMENTS

| | | | | |
|---|---|---|---|---|
| 5,897,060 | A * | 4/1999 | Kon | B05B 5/0407 239/223 |
| 5,941,457 | A | 8/1999 | Nakazono et al. | |
| 6,050,499 | A * | 4/2000 | Takayama et al. | 239/112 |
| 6,189,804 | B1 | 2/2001 | Vetter et al. | |
| 6,230,994 | B1 * | 5/2001 | Boerner | B05B 3/1064 118/620 |
| 6,360,962 | B2 | 3/2002 | Vetter et al. | |
| 6,557,781 | B2 * | 5/2003 | Kon | B05B 3/1064 239/104 |
| 6,592,054 | B2 * | 7/2003 | Prus | 239/224 |
| 7,017,835 | B2 | 3/2006 | Vetter et al. | |
| 2002/0023971 | A1 | 2/2002 | Ochiai et al. | |
| 2009/0020635 | A1 * | 1/2009 | Yasuda | B05B 3/1064 239/703 |
| 2013/0026258 | A1 * | 1/2013 | Motozaki | B05B 3/1014 239/700 |

FOREIGN PATENT DOCUMENTS

| | | | | |
|---|---|---|---|---|
| JP | 08024721 | * | 1/1996 | B05B 5/04 |
| JP | 09-234393 | | 9/1997 | |
| JP | 10-165848 | | 6/1998 | |
| JP | 11-057538 | | 3/1999 | |
| JP | 2001-104841 | | 4/2001 | |
| JP | 2002-166199 | | 6/2002 | |
| JP | 2002-224593 | | 8/2002 | |
| JP | 2005-118710 | | 5/2005 | |
| JP | 2005-177607 | | 7/2005 | |
| JP | 2009-119402 | | 6/2009 | |
| WO | 2011083829 A1 | | 7/2011 | |

OTHER PUBLICATIONS

European Search Report issued in corresponding European Patent Application No. 11 81 9814.2 dated Jul. 15, 2014 (5 pages).

* cited by examiner

ROTARY ATOMIZING HEAD FOR ELECTROSTATIC COATER

The present application is a continuation of International Patent Application No. PCT/JP2011/068453, filed on Aug. 12, 2011, which, in turn, claims priority from Japanese Patent Application No. 2010-188344, filed Aug. 25, 2010.

FIELD OF THE INVENTION

The present invention generally relates to an electrostatic coater, and more particularly, to a rotary atomizing head, which is to be attached to the electrostatic coater.

BACKGROUND OF THE INVENTION

Electrostatic coaters have become used in various fields of industry, and those having a rotary atomizing head are widely used for coating vehicle bodies, for example. These electrostatic coaters are called rotary atomizing coaters. As disclosed in Patent Documents 1 to 8, such a rotary atomizing head is an assembly of an atomizing head body and a structural component to be disposed in the central portion of the atomizing head body. Paint is supplied to the rotary atomizing head through a feed tube, and atomized by the rotary atomizing head that rotates at a high speed. For assuring the high speed, the rotary atomizing head is required to be highly precisely balanced in rotation.

For internal cleaning of the rotary atomizing head, there have been developed techniques for facilitating disassembly and reassembly of the rotary atomizing head. Patent Document 1 discloses a rotary atomizing head that permits the structural component to be accessed from the back thereof and attached to the atomizing head body. Patent Document 1 proposes to form paint discharge openings in the atomizing head body and attach a structural component to the atomizing head body from behind it to define a paint chamber between the structural component and the atomizing head body in the rotary atomizing head. The chamber is for receiving paint supplied from a feed tube.

Patent Documents 2 et seq. disclose rotary atomizing heads of a type in which a hub member, which is a structural component, is accessed from the front side of the atomizing head body and attached to the latter. Patent Document 2 proposes to fix the hub member in a central concavity of the atomizing head body via an elastic ring. More specifically, the rotary atomizing head disclosed in Patent Document 2 has a circumferential groove (first circumferential groove) formed in the circumferential wall of the central concavity of the atomizing head body and another circumferential groove (second circumferential groove) formed in the circumferential surface of the hub member. With the elastic ring being interposed between the first and second circumferential grooves, the hub member is detachably fixed to the atomizing head body.

In the rotary atomizing head of Patent Document 2, the hub member can be easily detached from the atomizing head body, and it can be attached again to the atomizing head body after cleaning.

The rotary atomizing head disclosed by Patent Document 3 is another prior-art example that can be disassembled and reassembled. The rotary atomizing head of Patent Document 3 has a shoulder formed at the front end of the circumferential wall of the central concavity in the atomizing head body. Patent Document 3 proposes to fit the hub member, which is disc-shaped, onto the shoulder. More particularly, the disc-shaped hub member has elasticity and flexibility given by its shape and material properties, and it is brought into fitting engagement with the shoulder of the atomizing head body under the elasticity and flexibility. Further, to prevent the hub member from slipping off forward of the atomizing head body, Patent Document 3 uses a retaining circumferential ridge formed on the circumferential surface of the shoulder of the atomizing head, or tapers the circumferential surface of the shoulder to be narrower forward. Patent document also discloses a rotary atomizing head of Patent Document 3 having a spoon-cut recess formed in the bottom of the central concavity of the atomizing head body. A wall surface continuous to the spoon-cut recess is shaped to make an inclined wall surface gradually widened forward. The above-mentioned disc-shaped hub member has a plurality of paint discharge openings formed concentrically in the outer circumferential surface thereof. The paint discharge openings extend tangentially to the inclined wall surface.

Patent Document 4 proposes using a permanent magnet attached to a disc-shaped hub member and another permanent magnet attached to an atomizing head body, which receives the disc-shaped hub member, to secure the disc-shaped hub member to the atomizing head body with an attraction force of the permanent magnets.

Patent Document 5 proposes to use a disc-shaped hub member having a number of legs. A free end of each leg is put in engagement with the circumferential recess in the central concavity of the atomizing head body to detachably hold the hub member in the atomizing head body. Further to this, Patent Document 5 proposes providing a clearance between the outer circumferential surface of the disc-shaped hub member and the atomizing head body to use it as a paint path.

DOCUMENTS OF EXISTING ARTS

Patent Documents

Patent Document 1: Japanese Patent Laid-Open Publication No. JP 2005-118710

Patent Document 2: Japanese Patent Laid-Open Publication No. JP H9(1997)-234393

Patent Document 3: Japanese Patent Laid-Open Publication No. JP 2001-104841

Patent Document 4: Japanese Patent Laid-Open Publication No. JP 2009-119402

Patent Document 5: Japanese Patent Laid-Open Publication No. JP 2002-224593

Patent Document 6: U.S. Pat. No. 6,189,804 B1

Patent Document 7: U.S. Pat. No. 6,360,962 B2

Patent Document 8: U.S. Pat. No. 7,017,835 B2

SUMMARY OF THE INVENTION

Problems to be Solved by the Invention

In the rotary atomizing head of Patent Document 2, fixation of the hub member to the atomizing head body relies solely on a resistance force deriving from the elasticity of the O-ring. It is therefore necessary to pay attention to possible deterioration of the O-ring. In addition, since the fixation of the hub member depends upon the elasticity of the O-ring, it is difficult to confirm whether the hub member gets in a proper position when the hub member is attached to the atomizing head body. Furthermore, since the rotary atomizing head rotates at a high speed, the O-ring is deformed under a centrifugal force, and this cause the problem of degradation of its sealing performance.

Interposing the O-ring between the atomizing head body and hub member means that the atomizing head has a relatively large clearance between the atomizing head body and hub member. This technique is considered to use the O-ring while leaving intrusion of paint through the clearance. In the case that paint of a color must be changed to paint of another color, rotary atomizing heads, in general, should be cleaned inside without being disassembled. However, once the paint enters the clearance between the atomizing head body and hub member, it is difficult to remove it. For this and other reasons, the invention disclosed in Patent Document 2 has not yet been carried out.

Patent Document 3 proposes to snap-fit the disc-shaped hub member onto the shoulder of the atomizing head body and prevent it from dropping forward of the atomizing head body by forming a circumferential ridge on the circumferential surface of the shoulder or tapering the circumferential surface of the shoulder to decrease its diameter forward. However, this invention has not been carried out either.

Patent Document 4 proposes to secure the disc-shaped hub member and atomizing head body by using an attraction force of permanent magnets. This embodiment of Patent Document 4 has the disadvantage that the materials of the disc-shaped hub member and atomizing head body must be non-magnetic materials (aluminum).

In the rotary atomizing head of Patent Document 5, the disc-shaped hub member is fixed by engagement of its legs in the circumferential recess formed in the circumferential wall of the central concavity in the atomizing head body, and paint discharge openings are formed between the neighboring ones of the legs in the clearance between the outer circumferential surface of the disc-shaped hub member and circumferential wall of the central concavity. This rotary atomizing head has the problem that paint inevitably adheres to the circumferential recess and legs, and it remains unremoved even with an effort to wash it away by using a liquid supplied to those portions of the rotary atomizing head. Because of this difficulty, Patent Document 5 explains in detail about how to detach and disassemble the hub member from the atomizing head body for cleaning purposes.

It is therefore an object of the present invention to provide a rotary atomizing head for an electrostatic coater, which is washable not only by disassembling but also by internal cleaning without disassembling to change the paint from one of a certain color to another of a different color.

A further object of the invention is to provide a rotary atomizing head for an electrostatic coater, which can be manufactured at a relatively low cost.

A still further object of the invention is to provide a rotary atomizing head for an electrostatic coater, which prevents generation of bubbles in paintworks on objects.

Means for Solution of the Problems

According to the present invention, there is provided a rotary atomizing head (100, 200, 300) for an electrostatic coater, including an assembly of an atomizing head body (2) and a structural component (4), in which the atomizing head body (2) has an inner circumferential surface (2*b*) on which paint flows under the centrifugal force, and the structural component (4) accessible from the front of the atomizing head body (2) to be removably fixed in a central concavity (6) formed in the central portion of the atomizing head body (2), said structural component (4) comprising:

a front wall (10) forming a disc-shaped hub contiguous to the inner circumferential surface (2*b*) of the atomizing head body (2);

a plurality of paint discharge openings (30) formed at circumferentially regular intervals in an outer circumferential surface of the front wall (10);

a plurality of cleaning openings (36) formed in the central portion of the front wall (10);

a side wall (12) extending rearward from the outer circumferential surface of the front wall (10) to be circumferentially continuous;

a plurality of legs (14) extending rearward from the outer circumferential surface of the rear end of the side wall (12);

a pawl (14*a*) protruding outwardly from the rear end of each leg (14) into a circumferential recess (16) formed in a circumferential wall (8) of the central concavity (6) for engagement on a side wall of the circumferential concavity (6);

a bottom wall (18) disposed radially inside the plurality of legs (14); and a spoon-cut recess (34) formed in the bottom wall (18).

Effects of the Invention

According to the above-mentioned embodiment, the structural component (4) can be detachably fixed to the atomizing head body (2) by the use of the pawls (14*a*) formed at the ends of the legs (14) of the structural component (4). Since the structural component (4) has the spoon-cut recess (34) formed in the bottom wall (18) thereof and the side wall (12) continuous from the spoon-cut recess (34) makes a circumferentially continuous plane, paint supplied to a paint space (20) in the structural component (4) can smoothly flow out into the circumferential recess (16) of the atomizing head body (2) through the paint discharge openings (30). Thus, it is prevented that the paint stagnates inside the structural component (4).

This effect of preventing stagnation of paint in the structural component 4 is also true in relation to cleaning of the rotary atomizing head (100). That is, when the structural component (4) is supplied inside with a cleaning liquid (typically a thinner), the paint space inside the structural component can be cleaned by the cleaning liquid such that no paint remains.

According to a preferred embodiment of the present invention, when the structural component (4) is mounted in the atomizing head body (2), a shoulder (40) having a dam function is formed between the structural component (4) and atomizing head body (2). According to a variant of this embodiment, the shoulder (40) is formed on the structural component (4). The shoulder (40) functions to spread the paint thin and wide, and therefore can prevent undesirable intake of bubbles into a layer of the paint coated on an object.

The foregoing and other features, aspects and advantages of the present invention will become more apparent from the detailed description of preferred embodiments that will follow.

DETAILED DESCRIPTION OF THE INVENTION

Figure 1:
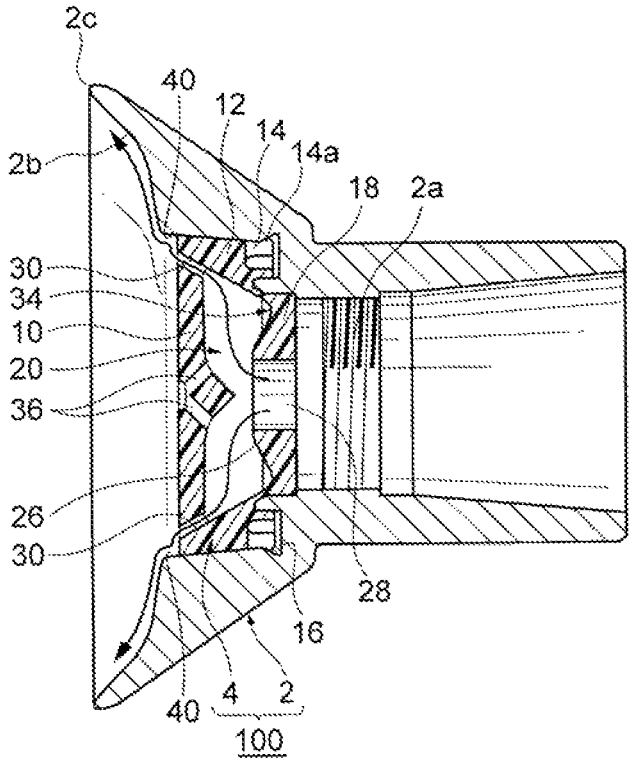
FIG. 1 is a cross-sectional view of a rotary atomizing head taken as a first embodiment of the present invention.
Figure 2:
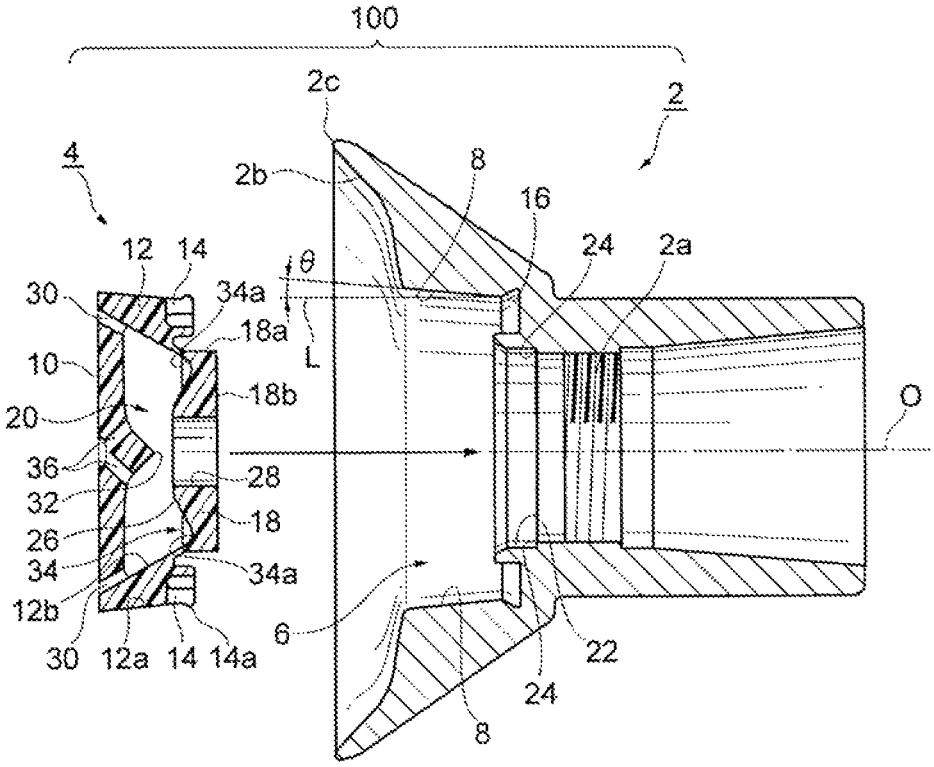
FIG. 2 is an exploded cross-sectional view of the rotary atomizing head according to the first embodiment (FIG. 1).
Figure 3:
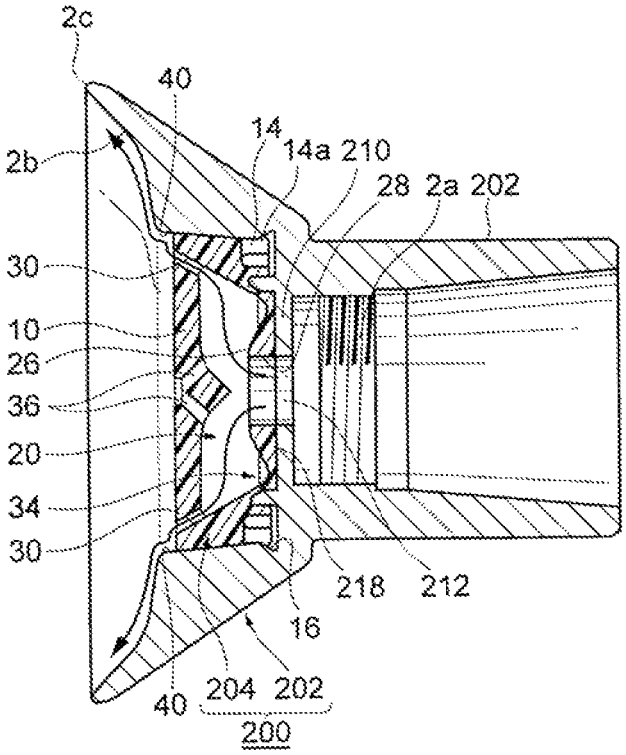
FIG. 3 is a cross-sectional view of a rotary atomizing head taken as a second embodiment of the present invention.
Figure 4:
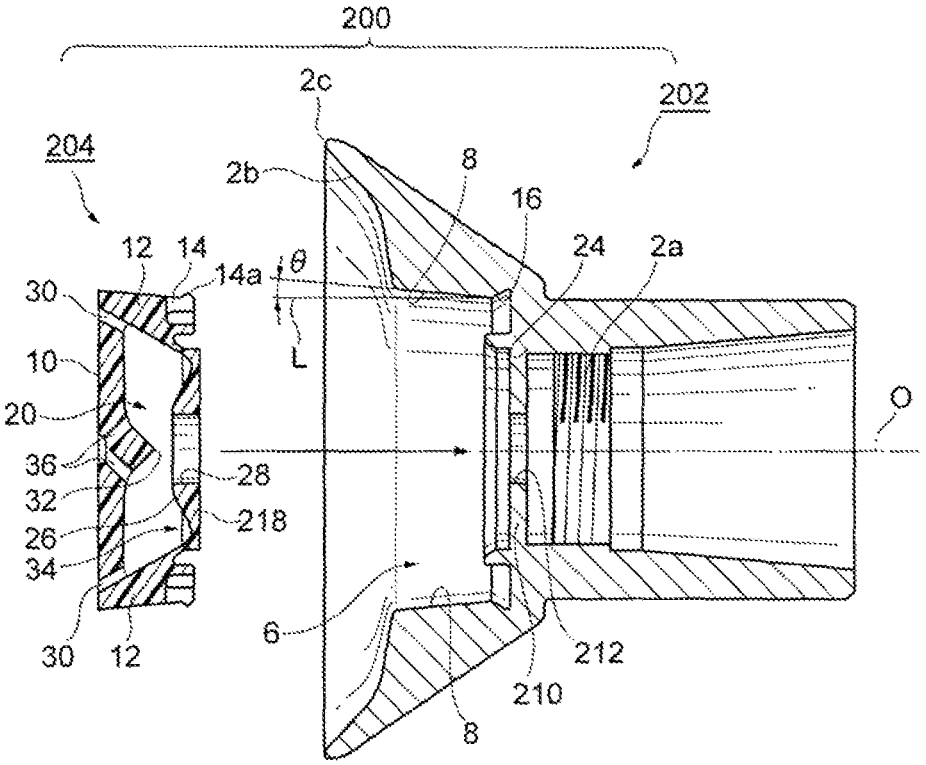
FIG. 4 is an exploded cross-sectional view of the rotary atomizing head according to the second embodiment (In FIG. 3).
Figure 5:
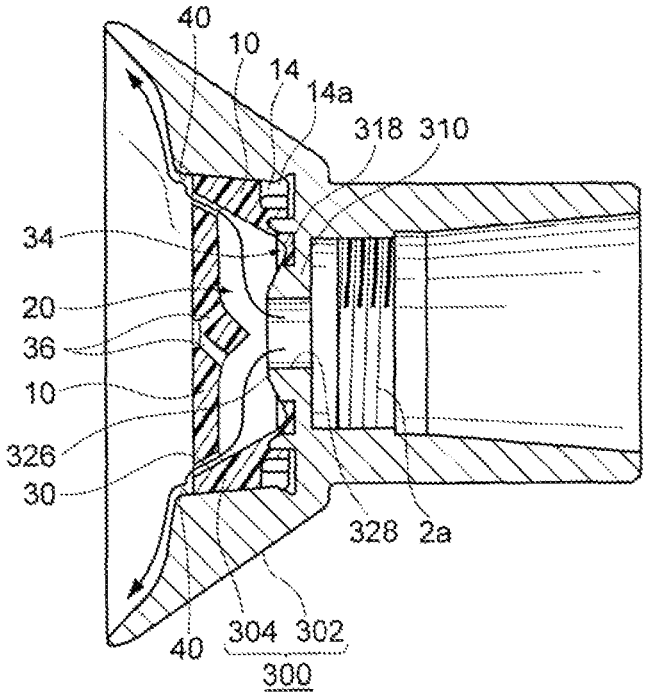
FIG. 5 is a cross-sectional view of a rotary atomizing head taken as a third embodiment of the present invention.
Figure 6:
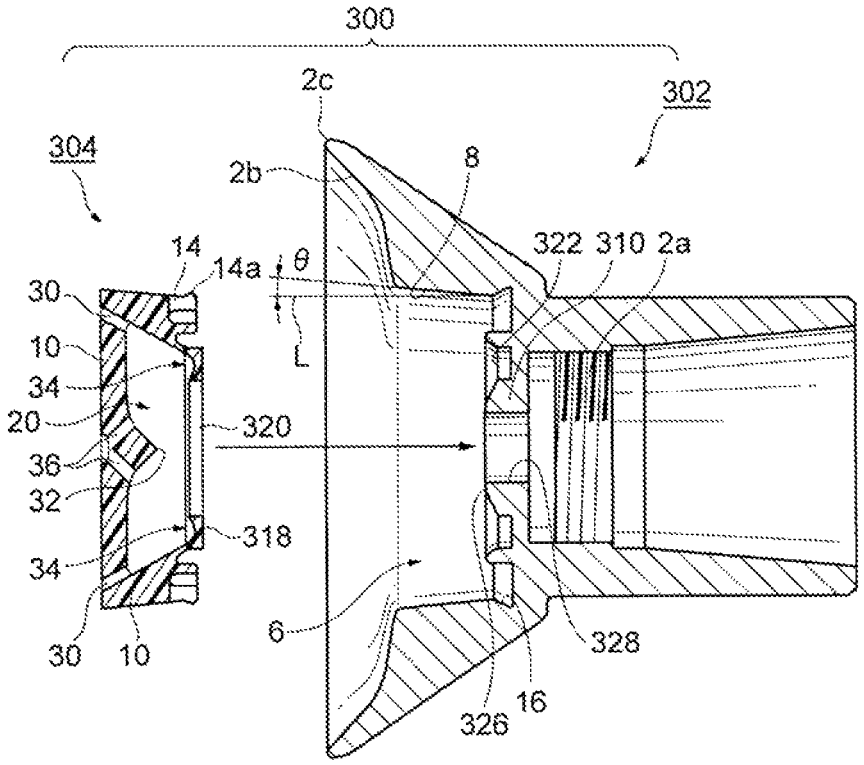
FIG. 6 is an exploded cross-sectional view of the rotary atomizing head according to the third embodiment (in FIG. 5).

The present invention will be described in detail below concerning some preferred embodiments thereof with reference to the accompanying drawings. It should be noted however that the present invention is not limited to the embodiments. FIGS. 1 to 6 show the rotary atomizing head dismounted from a rotary atomization type electrostatic coater. FIGS. 1 and 2 are cross-sectional views of the rotary atomizing head according to the first embodiment of the present invention. FIGS. 3 and 4 are cross-sectional views of the rotary atomizing head according to the second embodiment of the present invention. FIGS. 5 and 6 are cross-sectional views of the rotary atomizing head according to the third embodiment of the present invention.

First Embodiment (FIGS. 1 and 2):

The rotary atomizing head according to the first embodiment labeled with 100 includes an atomizing head body 2 and a structural component 4. The structural component 4 is detachably mountable in the atomizing head body 2. As disclosed in Patent Documents 1 and 2, the rear end portion of the atomizing head body 2 has formed a threaded portion 2*a* for receiving a rotating shaft of an air motor (not shown) by screw engagement. The threaded portion 2*a* has a central axis, which is coaxial with the rotation axis of the rotary atomizing head 100. Like in conventional rotary atomizing heads, the rotary atomizing head 100 is rotated by an air motor.

As described in detail in Patent Document 1 and the like, the rotating shaft of the air motor is hollow, and a paint feed tube is inserted through the hollow inner space of the rotating shaft. That is, paint is supplied to the central portion of the rotary atomizing head 100 through the paint feed tube. A space between the outer circumferential surface of the paint feed tube and inner circumferential surface of the rotating shaft is used as a path for a cleaning liquid (typically a thinner). The rotary atomizing head 100 is washed with the cleaning liquid supplied through the cleaning liquid path. Aspects of supplying paint and cleaning liquid are explained in detail in Patent Document 3, and the present specification invokes the explanation of Patent Document 3 to avoid redundancy of explanation.

FIG. 2 is an exploded view of the rotary atomizing head 100, in which the structural component 4 has been detached from the atomizing head body 2. With the rotary atomizing head 100 being decomposed, the atomizing head body 2 and structural component 4 can be washed to remove paint having adhered to them and, if necessary, the structural component 4 can be replaced with a new one.

With reference to FIG. 2, the atomizing head body 2 is a molded object of an electrically conductive material such as aluminum alloy, stainless steel alloy or hard resin shaped in the form of a bell like conventional ones. That is, the atomizing head body 2 has an inner circumferential surface 2*b* which is open to the front and continuous to an outer circumferential edge 2*c* of the atomizing head body 2. When a high voltage is applied to the atomizing head body 2, it can electrostatically charge the paint.

In the central portion of the inner circumferential surface 2*b* of the atomizing head body 2, a central concavity 6 that is open forward (FIG. 2). The central concavity 6 has a cylinder-like form that gradually increases its diameter forward. More particularly, the central concavity 6 is defined by a circumferential wall 8 inclined at an angle of θ with respect to a line L parallel to the rotation axis O of the rotary atomizing head 100 to define a cylindrical shape having a front end portion gradually increasing its diameter forward.

The structural component 4 is a product prepared as a relatively hard member by molding a synthetic resin such as PEEK (polyether ether ketone) for example. The structural component 4 has a cylindrical shape complementary with the central concavity 6. That is, the structural component 4 has a front wall 10 that is disc-shaped in its front view. The front wall 10 is a portion having the function of a hub member in some conventional electrostatic atomizing heads.

The structural component 4 further has a side wall 12 extending rearward from the outer circumferential surface of the front wall 10. The side wall 12 makes a circumferentially continues plane. The side wall 12 includes an outer circumferential surface 12*a* and inner circumferential surface 12*b*. The outer circumferential surface 12*a* has a form complementary with the circumferential wall 8 of the central concavity 6 in the aforementioned atomizing head body 2, which is generally cylindrical and gradually widened in diameter forward.

The structural component 4 has a plurality of legs 14 extending rearward from the side wall 12 and aligned circumferentially at regular intervals. Each of the legs 14 has formed at the rear end or free end thereof a pawl 14*a* projecting radially outward. When the structural component 4 is introduced into the central concavity 6 of the atomizing head body 2 from its front end and mounted therein, the legs 14 resiliently deform to permit the insertion of the structural component 4 into the central concavity from the front end. Once the structural component 4 takes its proper position, the pawls 14*a* of the legs 14 enter the circumferential recess 16 (FIG. 2) formed at the rear end of the circumferential wall of the central concavity 6 and get in engagement with the side wall of the circumferential recess 16. Thus, the structural component 4 is detachably but firmly held inside the atomizing head body 2 (FIG. 1).

The structural component 4 has a bottom wall 18 continuous to the rear end of the side wall 12. The structural component 4 has a paint space 20 defined by the bottom wall 18, front wall 10 opposite to the bottom wall 18, and side wall 12.

The bottom wall 18 of the structural component 4 has an outer circumferential surface 18*a*, which is cylindrical, and a rear end face 18*b*, which is flat. To fittingly receive the bottom wall 18, the atomizing head body 2 has a large-diameter cavity 22 having a diameter slightly larger than the threaded portion 2*a* and a shoulder 24 at the rear end of the large-diameter cavity 22, both located forward of the threaded portion 2*a*. When the structural component 4 is mounted in the atomizing head body 2, the structural component 4 is positionally fixed by engagement of the outer circumferential portion of the rear end surface of the bottom wall 18 with the shoulder 24.

The bottom wall 18 of the structural component 4 has formed in the central portion thereof a circumferential ridge 26 projecting frontward toward the paint space 20 and continuous circumferentially. The bottom wall 18 also has an axially extending central opening 28 surrounded by the circumferential ridge 26. The above-mentioned paint feed tube is inserted in this central opening 28.

In the outer circumferential portion of the front wall 10 forming a hub portion, the structural component 4 has a plurality of paint discharge openings 30 formed at regular intervals on a common circle. Further, the front wall 10 has formed in the central portion thereof a dividing peak 32 projecting rearward into the paint space 20 like in conventional atomizing heads. Four cleaning openings 36 are formed at regular intervals on a circle about the dividing peak 32.

Regarding the side wall 12 of the structural component 4, its inner circumferential surface 12*b* provides an inclined wall gradually expanded in diameter forward. The paint discharge openings 30 are positioned to be continuous to the front end of the inner circumferential surface 12*b*. The paint discharge openings 30 extend in the same direction as the direction of inclination of the inner circumferential surface 12*b* of the side wall 12.

In a forward facing surface of the bottom wall 18 of the atomizing head body 2, which is the surface opposed to the front wall 10 as a hub portion, a spoon-cut recess 34 is formed to extend continuously in the circumferential direction and coaxially with the central opening 28. The spoon-cut recess 34 has an outer circumferential surface 34*a* continuous to the rear end of the inner circumferential surface 12*b* of the side wall 12 and inclined by an approximately equal angle to the inclination angle of the inner circumferential surface 12*b* such that the outer circumferential surface 34*a* be flush with the inner circumferential surface 12*b* of the side wall 12.

As shown in FIG. 1, the rotary atomizing head uses no sealing member (O-ring) between the atomizing head body 2 and the structural component 4 mounted in the atomizing head body 2. Instead, the outer circumferential surface 12*a* of the structural component 4 is substantially in contact with the circumferential wall 8 of the central concavity 6 throughout the entire length from the front end to the rear end thereof. In addition, the circumferential wall 8 is an inclined wall increased in diameter forward, and the paint discharge openings 30 are formed radially outward of the front wall 10 of the structural component 4, which functions as a hub portion.

Under these physical features of the embodiment, paint having flown out of the paint discharge openings 30 is centrifugally spread to flow radially outward via the outer circumferential edge of the front wall 10 of the structural component 4, and subsequently flows radially outward, traveling on the inner circumferential surface 2*b* of the atomizing head body 2, which is contiguous to the front wall 10 of the structural component 4. Of course, the paint is eventually discharged from the outer circumferential edge 2*c* like in conventional rotary atomizing heads. In this process, since the structural component 4 is substantially in contact with the circumferential wall 8 of the central concavity 6 throughout the entire length of the structural component 4 from the front end to the rear end thereof, there is only a small possibility that paint enters into between the structural component 4 and central concavity 6. In other words, even if paint enters between the structural component 4 and central concavity 6, the circumferential wall of the central concavity 6, which inclines to increase its diameter forward, ejects it away under the centrifugal force. Therefore, it is prevented that paint enters into a clearance between the structural component 4 and the central concavity 6 of the atomizing head body 2 receiving the structural component 4 therein and dries there.

When the rotary atomizing head 1 is to be cleaned by cleaning before using paint in another color, a cleaning liquid (typically a thinner) is supplied to the rotary atomizing head 100 as done in some conventional rotary atomizing heads. The thinner cleans the inside of the structural component 4 while flowing in the paint space surrounded by the continuous side wall 12 of the structural component 4, and it is discharged externally through the cleaning openings 36 and paint discharge openings 30.

In the paint space 20 surrounded by the side wall of the structural component 4 (FIG. 1), the wall surface defining the paint space 20 provides a smoothly continuous and flush plane as will be understood from the above explanation. In other words, the wall surface of the paint space 20 makes no shoulders or other surface irregularities that may cause the paint to stay and stick. Therefore, it is possible to prevent the paint from staying and accumulating on the surfaces defining the paint space 20 and to the entirety of the paint space 20 not to leave any residual paint behind.

After a long-term use, the rotary atomizing head may exhibit the phenomenon that paint enters and dries in a clearance, for example, between the structural component 4 and central concavity 6 of the atomizing head body 2. If this phenomenon occurs, the structural component 4 and the atomizing head body 2 may be cleaned individually after removing the former from the latter on a regular or irregular basis. Since the structural component 4 made of a plastic resin will be commercially available at a low cost, it may be replaced with a new one, if so desired, in that occasion.

As best shown in FIG. 4, the rotary atomizing head 100 according to this embodiment has a simple structure in which the atomizing head body 2 has the opening that is approximately uniform in diameter from the threaded portion 2*a* to the central concavity 6. Therefore, the atomizing head body 2 can be manufactured easily, and its manufacturing cost can be reduced.

Referring back to reference to FIG. 1, the depth of the central concavity 6 in the atomizing head body 2 and thickness of the structural component 4 should preferably be determined such that a shoulder 40 is defined between the front wall 10 of the structural component 4 and inner circumferential surface 2*b* of the atomizing head body 2 when the structural component 4 is mounted in the atomizing head body 2. As already explained, the circumferential wall 8 of the central concavity 6 forms an angle of $\theta$ relative to the rotation axis O of the rotary atomizing head 100. Since this angle $\theta$ is as small as can be approximated to zero, the shoulder 40 is formed of a wall standing approximately at a right angle with respect to the front face of the front wall 10 of the structural component 4.

The shoulder 40 will be referred to as "dam" hereunder. Paint having flown out of the paint discharge openings 30 in the front wall 10 flows along the inner circumferential surface 2*b* of the atomizing head body 2 that extends radially outward. The paint is subsequently discharged from the outer circumferential edge of the atomizing head body 2 as already explained. However, the paint having flown out of the paint discharge openings 30 is blocked for a moment by the dam (shoulder 40) before moving further. Through Inventors' experiments, it has been proved that the shoulder 40 acts as a dam and that bubbles in the paint disappear as a result of the damming effect of the shoulder 40. In other words, the object coated by the rotary atomizing head 1 having the above-mentioned shoulder 40 had paintwork that was free from bubbles and outstandingly smooth.

The second and third embodiments of the present invention are next explained hereunder. In the next explanation of these embodiments, the same elements as those in the first embodiment are indicated with the same reference numerals as those used in the explanation of the first embodiment, and explanation of such same elements is omitted. Thus, the next explanation is directed to characterizing portions of these embodiments.

Second Embodiment (FIGS. 3 and 4):

The rotary atomizing head according to the second embodiment, designated by reference numeral 200, can be also regarded as a variant of the rotary atomizing head 100 having been explained above. As best understood by comparing FIG. 4 (showing the second embodiment) with FIG. 2 (showing the first embodiment), the rotary atomizing head 200 includes an atomizing head body 202 having a partition wall 210 between the threaded portion 2*a* and the central concavity 6. The partition wall 210 has formed a central opening 212.

The rotary atomizing head 200 according to the second embodiment includes a structural component 204 having a bottom wall 218 thinner than the bottom wall 18 of the structural component 4 included in the rotary atomizing head 100 according to the first embodiment. When the structural component 204 included in the second embodiment is mounted in the atomizing head body 202, the bottom wall 218 of the structural component 204 is seated on the partition wall 210.

Third Embodiment (FIGS. 5 and 6):

The rotary atomizing head according to the third embodiment, indicated with a reference numeral 300, includes a structural component 304. This structural component is different from the structural component 204 of the second embodiment in that it has a shape resulting from cutting away a part of the bottom wall 218 of the structural component 204 of the second embodiment, which is inner than the spoon-cut recess 34. That is, the structural component 304 of the rotary atomizing head 300 according to the third component has a bottom wall 318 in which the spoon-cut recess 34 is formed and of which a portion inner than the spoon-cut recess 34 is cut away to define a circular opening. The inner-circumferential cut-away portion is illustrated by labeling reference numeral 320 (FIG. 6).

The structural component 304 in the third embodiment does not have the circumferential ridge 26 and the central opening 28 that were included in the second embodiment as elements forming the radially inner structure of the spoon-cut recess 34. Instead, in the third embodiment, elements corresponding to the circumferential ridge 26 and central opening 28 are formed on a partition wall 310 of the atomizing head body 302. The element corresponding to the circumferential ridge 26 of the former embodiments is indicated with reference numeral 326 and the element corresponding to the central opening 28 of the former embodiments is indicated with reference numeral 328.

The partition wall 310 has formed therein a recess 322 to receive the bottom wall 318 including the spoon-cut recess 34. The bottom wall receiving recess 322 extends continuously in the circumferential direction. As best seen shown in FIG. 5, when the structural component 304 is mounted in the atomizing head body 302, the circumferential ridge 326 and spoon-cut recess 34 make a contiguous, flush plane.

Figure 7:
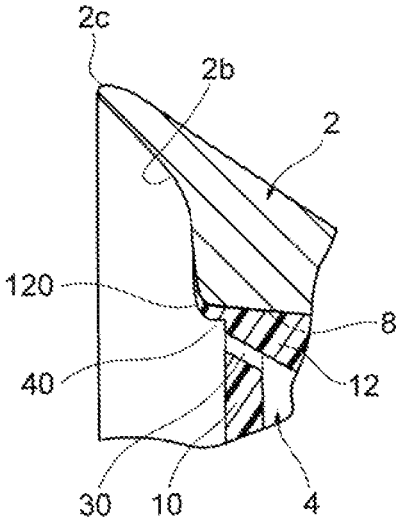
FIG. 7 is a cross-sectional view of an extracted substantial part of a rotary atomizing head according to a fourth embodiment of the present invention.

Fourth Embodiment (FIG. 7);

This embodiment can also be regarded as a variant of the above-mentioned structural component 4. With reference to FIG. 7, the structural component 4 has a lip 120 that is a forward extension of an outer marginal portion of the front end of the side wall 12. The lip 120 extends to fit on the inner circumferential surface 2*b* of the atomizing head body 2. The remainder region of the front end face of the side wall 12, which is radially inward of the lip 120, forms the aforementioned shoulder 40. The shoulder 40 illustrated herein is single-stepped, but it may be multi-stepped as well. By additionally making the lip 120 on the structural component 4 to form the shoulder 40, it is possible to have the shoulder 40 perform the function of a dam. Further, since the structural component 4 is made of a synthetic resin, more than one step, as well, can be easily designed and formed as the shoulder 40. In this fourth embodiment, the circumferential wall 8 of the central concavity in the atomizing head body 2 may be inclined at an angle of θ or may be a vertical plane extending along a line L (FIG. 1) parallel to the rotation axis O of the rotary atomizing head 100.

Figure 8:
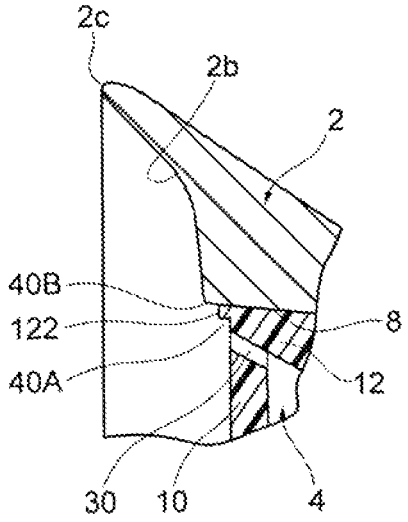
FIG. 8 is a cross-sectional view of an extracted substantial part of a rotary atomizing head according to a fifth embodiment.

Fifth Embodiment (FIG. 8):

This embodiment can also be regarded as a variant of the above-explained fourth embodiment. As shown in FIG. 8, the structural component 4 has a salient 122 that is formed by projecting forward an outer-circumferential portion of the front end of the side wall 12. The salient 122 results in forming a first shoulder 40A in the radially inner part of the front end face of the structural component 4. Furthermore, a second shoulder 40B is formed on the inner circumferential surface 2*b* of the atomizing head body 2 to be next to the salient 122 and atomizing head body 2. The first and second shoulders 40A and 40B act as a dam.

INDUSTRIAL APPLICABILITY

The present invention is suitably applicable for use with a rotary atomization type electrostatic coater.

LIST OF REFERENCE NUMERALS

100 Rotary atomizing head (first embodiment)
2 Atomizing head body
2*a* Threaded portion
2*b* Inner circumferential surface
2*c* Outer circumferential edge
4 Structural component
6 Central concavity (atomizing head body)
8 Circumferential wall of central concavity
10 Front wall of structural component (hub)
12 Side wall of structural component
12*a* Outer circumferential surface of side wall of structural component
12*b* Inner circumferential surface of side wall of structural component
14 Legs
14*a* Pawl of leg
16 Circumferential recess in atomizing head body
18 Bottom wall of structural component
18*a* Outer circumferential surface of bottom wall
18*b* Rear end face of bottom wall
20 Paint space
26 Circumferential ridge
28 Central opening
30 Paint discharge openings

34 Spoon-cut recess
40 Shoulder (dam)
200 Rotary atomizing head of second embodiment
300 Rotary atomizing head of third embodiment

What is claimed is:

1. A rotary atomizing head for an electrostatic coater, including an assembly of an atomizing head body and a structural component, in which the atomizing head body has an inner circumferential surface on which paint flows under the centrifugal force, and the structural component accessible from the front of the atomizing head body to be removably fixed in a central concavity formed in the central portion of the atomizing head body, wherein the rotary atomizing head is free of an O-ring between the atomizing head body and the structural component removably fixed in the atomizing head body, said structural component comprising:

a front wall forming a disc-shaped hub contiguous to the inner circumferential surface of the atomizing head body;

a plurality of paint discharge openings formed at circumferentially regular intervals in an outer circumferential surface of the front wall;

a plurality of cleaning openings formed in the central portion of the front wall;

a side wall extending rearward from the outer circumferential surface of the front wall to be circumferentially continuous;

a plurality of legs extending rearward from the outer circumferential surface of the rear end of the side wall;

a pawl protruding outwardly from the rear end of each leg into a circumferential recess formed in a circumferential wall of the central concavity for engagement on a side wall of the circumferential concavity;

a bottom wall disposed radially inside the plurality of legs;

a spoon-cut recess formed in the bottom wall; and a paint space defined by the front wall, the side wall and the bottom wall, and wherein the circumferential wall of the central concavity is formed of an inclined wall gradually increased in diameter forward;

wherein the outer circumferential surface of the side wall of the structural component is complementary in shape with the circumferential wall of the central concavity, and wherein the outer circumferential surface of the side wall of the structural component is in contact with the circumferential wall of the central concavity throughout the entire length of the structural component from a front end to a rear end thereof.

2. The rotary atomizing head according to claim 1, wherein the bottom wall of the structural component includes:

a circumferential ridge formed at a radially inward position of the spoon-cut recess and projecting toward the front wall, and a central opening formed at a radially inward position of the circumferential ridge and extending along the axis of the rotary atomizing head.

3. The rotary atomizing head according to claim 1, wherein the bottom wall of the structural component has a cylindrical outer circumferential surface;

wherein the atomizing head body has a large-diameter cavity to receive the bottom wall of the structural component and has a shoulder formed at the rear end of the large-diameter cavity; and wherein the bottom wall sits on the shoulder when the structural component is mounted in the atomizing head body and the bottom wall of the structural component is received in the large-diameter cavity.

4. The rotary atomizing head according to claim 1, wherein the structural component is formed of a relatively hard synthetic resin.

5. The rotary atomizing head according to claim 1, wherein a shoulder having a dam function is defined between the structural component and atomizing head body when the structural component is mounted in the atomizing head body.

6. The rotary atomizing head according to claim 2, wherein a shoulder having a dam function is defined between the structural component and atomizing head body when the structural component is mounted in the atomizing head body.

7. The rotary atomizing head according to claim 3, wherein a shoulder having a dam function is defined between the structural component and atomizing head body when the structural component is mounted in the atomizing head body.

8. The rotary atomizing head according to claim 1, wherein the structural component has formed a shoulder on an outer circumferential portion of the front end surface of the front wall, and the shoulder acts as a dam mechanism for receiving paint flowing out of the paint discharge openings and spreading it thin and wide, wherein the shoulder forms a first dam on the front surface of the structural component and a second dam between the structural component and the atomizing head body.

9. The rotary atomizing head according to claim 2, wherein the structural component has formed a shoulder on an outer circumferential portion of the front end surface of the front wall, and the shoulder acts as a dam mechanism for receiving paint flowing out of the paint discharge openings and spreading it thin and wide, wherein the shoulder forms a first dam on the front surface of the structural component and a second dam between the structural component and the atomizing head body.

10. The rotary atomizing head according to claim 3, wherein the structural component has formed a shoulder on an outer circumferential portion of the front end surface of the front wall, and the shoulder acts as a dam mechanism for receiving paint flowing out of the paint discharge openings and spreading it thin and wide, wherein the shoulder forms a first dam on the front surface of the structural component and a second dam between the structural component and the atomizing head body.

11. A method of reusing the rotary atomizing head of claim 1 for an electrostatic coater, comprising:

(i) preparing an assembly of an atomizing head body and a structural component, in which the atomizing head body has an inner circumferential surface on which paint flows under the centrifugal force, and the structural component accessible from the front of the atomizing head body to be removably fixed in a central concavity formed in the central portion of the atomizing head body, wherein the structural component comprising:

a front wall forming a disc-shaped hub contiguous to the inner circumferential surface of the atomizing head body;

a plurality of paint discharge openings formed at circumferentially regular intervals in an outer circumferential surface of the front wall;

a plurality of cleaning openings formed in the central portion of the front wall; a side wall extending rearward from the outer circumferential surface of the front wall to be circumferentially continuous;

a bottom wall continuous to a rear end of the side wall; a spoon-cut recess formed in the bottom wall; and a paint space defined by the front wall, the side wall and the bottom wall;

(ii) removing the structural component from the atomizing head body;

(iii) cleaning or disposing the structural component; and (iv) accessing from the front of the atomizing head body to fix the cleaned structural component or a new structural component in the central concavity of the atomizing head body.

12. The method of reusing the rotary atomizing head according to claim 11, wherein the structural component further comprising:

a plurality of legs extending rearward from the outer circumferential surface of the rear end of the side wall;

a pawl protruding outwardly from the rear end of each leg into a circumferential recess formed in a circumferential wall of the central concavity for engagement on a side wall of the circumferential concavity.

* * * * *